US008826497B2

(12) United States Patent
Amron

(10) Patent No.: US 8,826,497 B2
(45) Date of Patent: Sep. 9, 2014

(54) BANKNOTE ADAPTED TO FORM A MAGNETIC MONEY CLIP

(75) Inventor: Scott L. Amron, Smithtown, NY (US)

(73) Assignee: Invisible Money Clip, LLC, Scarsdale, NY (US)

( * ) Notice: Subject to any disclaimer, the term of this patent is extended or adjusted under 35 U.S.C. 154(b) by 46 days.

(21) Appl. No.: 13/037,664

(22) Filed: Mar. 1, 2011

(65) Prior Publication Data

US 2011/0232046 A1 Sep. 29, 2011

Related U.S. Application Data

(63) Continuation-in-part of application No. 12/578,087, filed on Oct. 13, 2009, now abandoned.

(60) Provisional application No. 61/196,006, filed on Oct. 14, 2008.

(51) Int. Cl.

| | |
|---|---|
| ***A45C 1/00*** | (2006.01) |
| ***H01F 7/02*** | (2006.01) |
| ***A45C 1/06*** | (2006.01) |

(52) U.S. Cl.

CPC ..... *A45C 1/06* (2013.01); *A45C 2001/062* (2013.01)

USPC ..... 24/303; 24/67 AR; 24/67.3

(58) Field of Classification Search

USPC ..... 24/67 AR, 67.3, 303

See application file for complete search history.

(56) References Cited

U.S. PATENT DOCUMENTS

| | | | | | |
|---|---|---|---|---|---|
| 2,448,611 | A | * | 9/1948 | Martin | 116/234 |
| 3,462,803 | A | * | 8/1969 | Horton | 403/267 |
| 3,618,174 | A | | 11/1971 | Schainholz | 24/303 |
| 4,222,489 | A | * | 9/1980 | Hutter | 211/45 |
| 4,255,837 | A | * | 3/1981 | Holtz | 24/303 |
| 4,258,493 | A | * | 3/1981 | Kettlestrings et al. | 40/600 |
| 4,588,209 | A | * | 5/1986 | Zebrowski et al. | 281/45 |
| 5,053,750 | A | | 10/1991 | Alex | 340/568.7 |
| 5,425,160 | A | * | 6/1995 | Krapf | 24/67 R |
| 5,682,653 | A | * | 11/1997 | Berglof et al. | 24/303 |
| 5,794,767 | A | | 8/1998 | Wilson | 206/37 |
| 5,893,586 | A | | 4/1999 | McGuire | 283/2 |
| 6,052,828 | A | * | 4/2000 | Widdemer | 2/161.2 |
| 6,094,755 | A | | 8/2000 | Matta | 4/558 |
| 6,101,688 | A | * | 8/2000 | Marchesi | 24/303 |
| 6,215,381 | B1 | * | 4/2001 | Aoki | 335/207 |
| 6,457,239 | B1 | * | 10/2002 | McLaughlin | 30/151 |
| 6,572,945 | B2 | * | 6/2003 | Bries et al. | 428/40.1 |
| 6,745,805 | B2 | * | 6/2004 | Thomson | 150/137 |
| 6,927,657 | B1 | * | 8/2005 | Wu | 335/284 |

(Continued)

OTHER PUBLICATIONS

International Preliminary Report on Patentability dated Apr. 28, 2011 issued in PCT International Application No. PCT/US09/06025.

*Primary Examiner* — Robert J Sandy
*Assistant Examiner* — David Upchurch
(74) *Attorney, Agent, or Firm* — Ostrolenk & Faber LLP

(57) ABSTRACT

A magnetic clip is provided having two magnetic components to create a low-cost, thin, soft magnetic vise-like mechanism. The magnetic components are disposed in individual stickers or a unitary sticker. The clip includes an adhesive layer to which a real banknote may be removably attached. The user can simply peel back the banknote to open the magnetic vise-like mechanism to insert or remove one or more banknotes. The user then folds the substrate back onto itself to close and secure the remaining banknote(s).

7 Claims, 8 Drawing Sheets

(56) References Cited

U.S. PATENT DOCUMENTS

| | | | | |
|---|---|---|---|---|
| 6,954,968 | B1 * | 10/2005 | Sitbon | 24/303 |
| 6,971,147 | B2 * | 12/2005 | Halstead | 24/303 |
| 7,066,494 | B1 * | 6/2006 | Di Prinzio | 281/42 |
| 7,120,970 | B2 * | 10/2006 | Thomson et al. | 24/67.5 |
| 7,278,230 | B2 | 10/2007 | Ray et al. | 40/638 |
| 7,644,489 | B2 * | 1/2010 | Arora et al. | 29/607 |
| 2002/0152650 | A1 | 10/2002 | Reeves | 40/1.5 |
| 2003/0074769 | A1 | 4/2003 | Just | 24/303 |
| 2003/0140996 | A1 | 7/2003 | Thomson | 150/138 |
| 2003/0155997 | A1 | 8/2003 | Thibideau | 335/207 |
| 2003/0221297 | A1 * | 12/2003 | Reiter | 24/303 |
| 2005/0039307 | A1 | 2/2005 | Loughlin et al. | 24/68 R |
| 2006/0243364 | A1 | 11/2006 | Bridgefarmer | 150/147 |
| 2006/0282993 | A1 * | 12/2006 | Dietz | 24/303 |
| 2007/0074377 | A1 * | 4/2007 | Wu | 24/67 R |

* cited by examiner

60d

60b

60c

BANKNOTE ADAPTED TO FORM A MAGNETIC MONEY CLIP

CROSS REFERENCE TO RELATED APPLICATIONS

This application is a Continuation-in-Part of U.S. Ser. No. 12/578,087, entitled "A BANKNOTE ADAPTED TO FORM A MAGNETIC MONEY CLIP which is based on and claims priority to Provisional application Ser. No. 61/196,006, filed Oct. 14, 2008 and entitled "A BANKNOTE ADAPTED TO FORM A MAGNETIC MONEY CLIP." The respective entire disclosures of the above noted applications are incorporated by reference herein.

BACKGROUND OF THE INVENTION

1. Field of the Invention

The present invention relates to a magnetic clip employing a connective substrate linking two or more magnetic components to provide a unique and intuitive money clipping utility.

2. Background

Magnetic money clips are used to keep paper money organized within a magnetic vise-like mechanism, offering a greater carrying capacity than that of a stiff and unforgiving metal money clip. Conventional money clips are generally comprised of one or more bulky leather substrates sized substantially smaller than the banknotes it is designed to hold. Magnetic components are placed at opposing ends of the substrate(s). The substrate is then folded at its center to create a vise-like clipping mechanism thereby doubling the device's profile. Small bulky magnetic money clips are awkward to handle and do not fit well in tight pockets. Current magnetic money clip assemblies fail to provide the user with an inexpensive, thin, soft, pliable, low-profile, easy-to-grab, and forgiving means of keeping paper money organized on-the-go.

SUMMARY OF THE INVENTION

It is a general object of the present invention to provide a magnetic money clip that avoids the drawbacks of prior magnetic money clips.

More, specifically, it is an object of the present invention to provide a magnetic money clip that is an inexpensive, thin, soft, pliable, low-profile, easy-to-grab, and a forgiving means of keeping paper money on-the-go.

These and other objects of the invention are achieved by a magnetic clip comprising a substrate and a coupled set of magnetic components. Means are provided to secure the magnetic components to the substrate.

In accordance with one aspect of the invention, a magnetic clip is provided having a connective paper substrate possessing the same size, shape and feel of a real banknote to provide a unique and intuitive money clipping utility. Two magnetically paired stickers are affixed to the paper substrate. Alternatively, the magnetic components may be embodied in a unitary structure.

Employing a real banknote as a connective paper substrate adds to the minimalist appeal. That is, the idea of clipping money with money and disguising the money clip as a banknote offers additional value as a novelty. The money clipping mechanism essentially disappears into the wad of cash, creating a bankroll that appears well-behaved without additional apparatus. The use of a real banknote as the paper substrate also provides the device with improved durability and mechanical performance over current magnetic money clips. Banknote paper is known to for its strength and durability. Its formula is considered a governmental secret. Although, banknote paper is more durable than paper found in the public domain, the current invention can be realized by employing alternative paper with mechanical characteristics similar to that of banknote paper.

Alternatively, the embodiment utilizing a unitary sticker may be folded in the opposite direction to expose the sticker which may have advertising, logos, or the like on its outer, exposed surface.

As used herein, the term "magnetic components" shall refer to any and all materials that possess magnetic properties including carbon steel, all materials that contain iron and non-metallic magnets made from organic polymers such as PANiCNQ, which is a combination of emeraldine-based polyaniline (PANi) and tetracyanoquinodimethane (TCNQ).

BRIEF DESCRIPTION OF THE DRAWINGS

The various features, functions and advantages characterizing the invention will be better understood by reference to the detailed description which follows, taken in conjunction with the accompanying drawings. It should be understood that the drawings are not necessarily drawn to scale and that, unless otherwise indicated, they are merely intended to conceptually illustrate the structures and procedures described herein. In the drawings, wherein like reference characters denote similar elements throughout the several views.

DETAILED DESCRIPTION OF THE INVENTION

Figure 1:
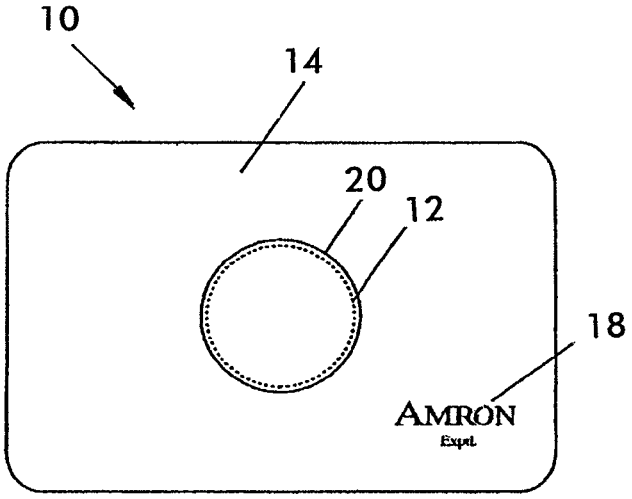
FIG. 1 is a front plan view of one of two magnetically paired stickers constructed in accordance with an illustrative embodiment of the present invention.
Figure 2:
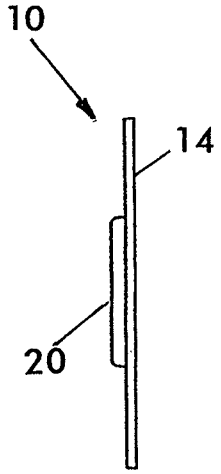
FIG. 2 is a side view of the magnetic sticker of FIG. 1.
Figure 3:
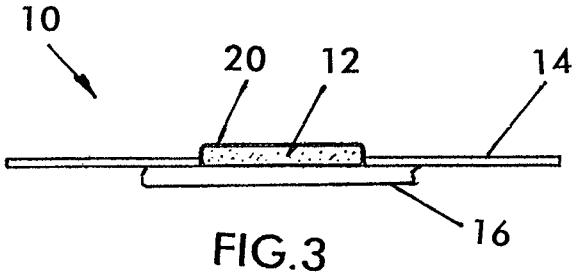
FIG. 3 is a longitudinal elevational view of the magnetic sticker of FIG. 1.

Referring now to the drawings and, in particular, to FIGS. 1-5, there is shown one of two magnetically paired stickers 10 constructed in accordance with the preferred embodiment of the present invention. The magnetic sticker 10 contains a neodymium disc magnet 12 measuring 0.8 mm thick and 12 mm in diameter embedded in a fabric reinforced label 14 having a pressure sensitive adhesive backing 16. The label 14 has been die-cut to shape and embossed to create a corporate logo 18 and cavity 20 in which the magnet 12 sits.

Figure 6:
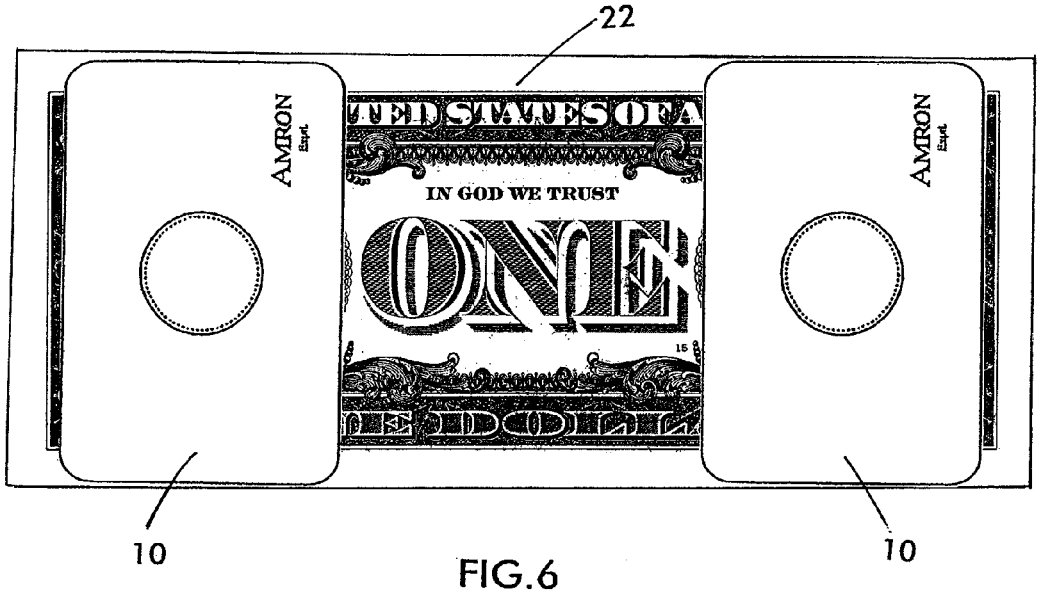
FIG. 6 is a plan view of two magnetically paired stickers affixed to a ONE-dollar bill.

Referring to FIG. 6, two of the magnetically paired stickers 10 are attached to a substrate, which, in a preferred embodiment, is a real paper banknote, such as a ONE-dollar bill 22. In the case where the substrate is a banknote, such as the bill 22, the adhesive backing 16 is of a type such that the stickers 10 may be removed from the bill 22 without any damage thereto. An appropriate adhesive is duct tape. An appropriate epoxy may also be used.

Figure 4:
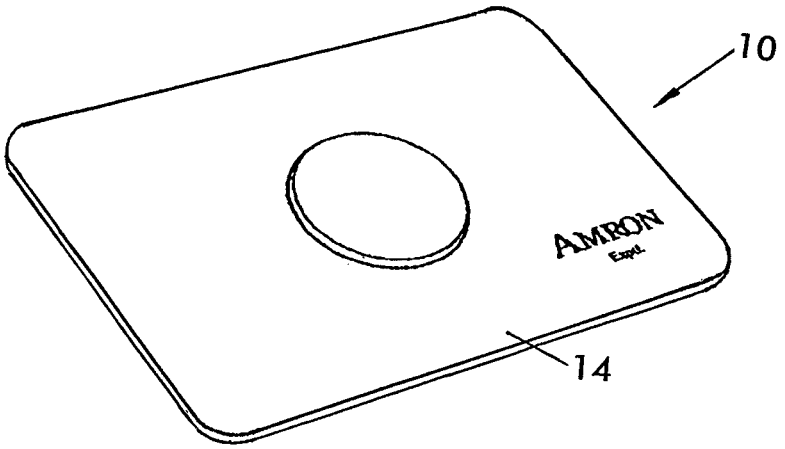
FIG. 4 is perspective view of the top of one of two magnetically paired stickers constructed in accordance with an illustrative embodiment of the present invention.
Figure 5:
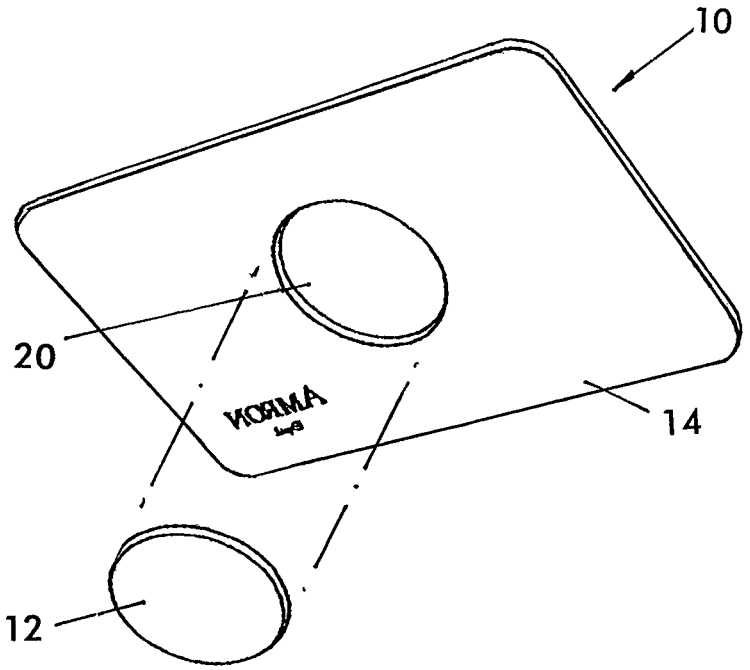
FIG. 5 is an exploded perspective view of the bottom of one of two magnetically paired stickers constructed in accordance with an illustrative embodiment of the present invention.
Figure 7:
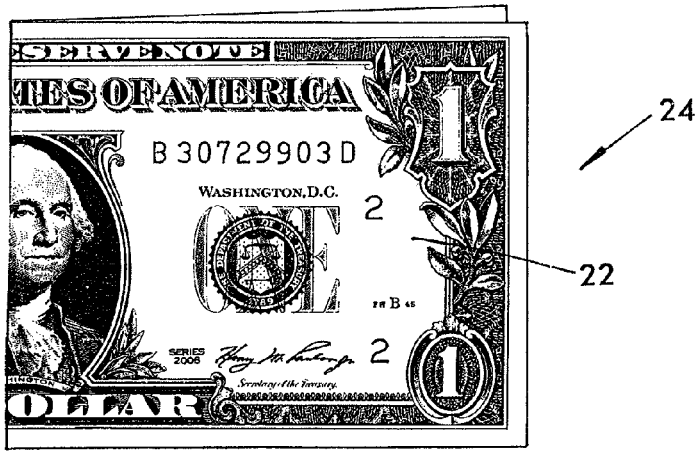
FIG. 7 is a plan view of the ONE dollar bill with magnetic stickers of FIG. 4 folded to create a magnetic money clip.

FIG. 7 shows the dollar bill 22 (and stickers) of FIG. 4 folded at its center to create a magnetic money clip 24 with magnetic vise-like mechanism. Banknotes can be placed between the folded magnetic ends. The user can easily peel back the dollar bill substrate 22 when removing the secured banknotes. The user can handle the magnetic clip 24 as if it were any other dollar bill in the wad of cash.

Figure 8:
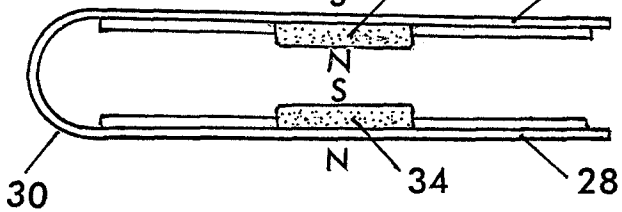
FIGS. 8-11 are elevation views of magnetically paired stickers attached to a paper substrate illustrating various configurations of magnetic components.

FIG. 8 shows two magnetically paired stickers 26 and 28 attached to a paper substrate 30. The stickers 26 and 28 contain magnets 32 and 34, respectively. The magnets 32 and 34 are oriented with opposite poles facing inward (NS or SN) to create the attractive vise-like magnetic mechanism. This configuration offers a self centering feature as the two magnets 32 and 34 center themselves on each other to give a perfectly symmetric close every time even when carelessly flipped.

Figure 9:
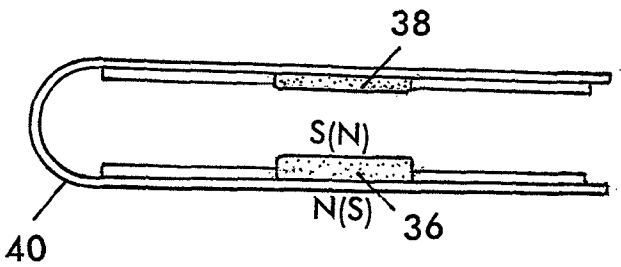

FIG. 9 shows one magnet 36 that can be oriented with either its North or South face exposed to a steel plate 38 of the opposing end of the paper substrate 40. In this configuration both the magnet 36 and the steel plate 38 act as "magnetic components." This configuration offers the lowest cost to manufacture. It does not provide the self-centering feature offered by the configuration in FIG. 8. It does however substantially cap the magnet's magnetic field, as the magnetic field of the magnet 36 does not penetrate through the steel plate 38 in the closed position.

Figure 10:
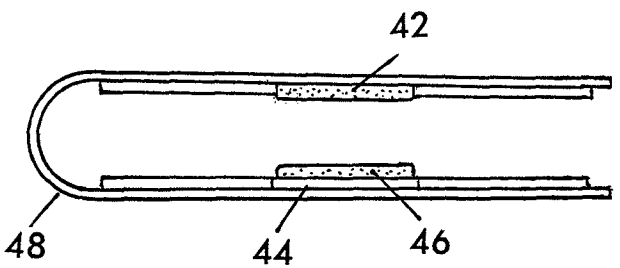

FIG. 10 shows two (2) steel plates 42 and 44 arranged to cap the magnetic field of a magnet 46 when the device is in the closed position. The magnet 46 is attracted to the steel plate 42 attached to the opposite end of the paper substrate 48. The steel plate 44 effectively strengthens magnet 46 by focusing its magnetic field in the direction of steel plate 42 on the opposite end of the paper substrate 48. This configuration offers a magnetic field capping function in both directions when in the closed position. But, it does not feature the self-centering effect had by the configuration shown in FIG. 8.

Figure 11:
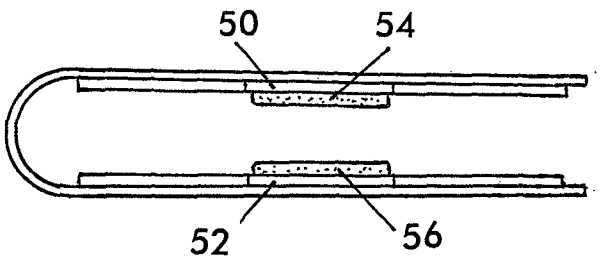

FIG. 11 shows two (2) steel plates 50 and 52 arranged to cap the magnetic fields of two magnets 54 and 56 when in the closed position. The magnets 54 and 56 are oriented with opposite poles facing inward (either NS or SN). This configuration offers both the bi-directional magnetic field capping feature had by the configuration of FIG. 10 and the self-centering feature had by FIG. 8.

Among the advantages and features of the foregoing embodiment, in addition to those already noted, are the following:

1. The magnetic money clip has the same size and feel as the cash it holds;
2. One could potentially use the money clip as currency when low on cash as the stickers are removable with no harm to the banknote;
3. The banknote may be of any denomination (e.g., 5, 10, 20, 50, and $100);
4. Subject to compliance with the laws of the EEC, can be made from Euro banknotes to hold Euro banknotes;
5. Prevents lower back pain caused by bulky wallets and bulky magnetic money clips;
6. Subject to compliance with the laws of the issuing country, obsolete paper currency such as the lire can be used as the paper substrate; and
7. Can be sold as a DIY (Do It Yourself) kit (with two magnetically paired stickers) or as an assembled magnetic money clip (a dollar bill with the two stickers already attached).

It should be noted that the use of banknotes as substrates in accordance with the present invention is subject to the laws of the country issuing the currency. For example, in the United States according to present law, it is illegal to deface currency in such a way that it is made unfit for circulation (Title 18, Section 333 of the United States Code). Since the present invention uses an adhesive that allows the bill to be removed without any damage, the bill is fit for circulation and, therefore, use of the invention with a U.S banknote fully complies with U.S. law.

Figure 12:
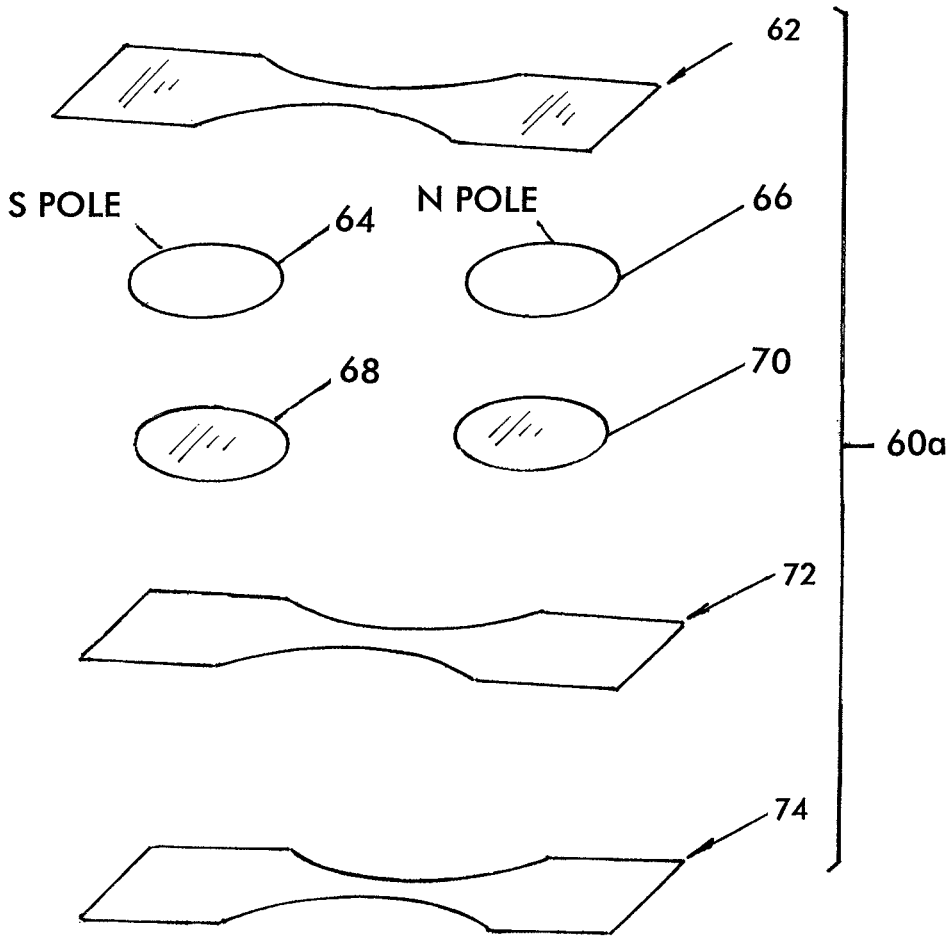
FIG. 12 is an exploded perspective view of a unitary magnetic sticker constructed in accordance with an alternative embodiment of the present invention.

An alternative to the use of two separate labels to form a money clip sticker is an embodiment in which the magnets are incorporated in a unitary structure. Referring to FIG. 12, a unitary money clip sticker 60*a* may be formed as follows:

a) A support substrate 62 of plastic, such as vinyl, leatherette, leather, plastic or any similar durable material;
b) two disc magnets 64 and 66 which have axially and oppositely magnetized poles on their flat faces and which may be neodymium magnets;
c) two steel shielding discs or plates 68 and 70;
d) Optional step down rings to facilitate assembly of the shielding plates and magnetic discs to the support substrate;
e) a sheet 72 of double sided adhesive which may be a watergel adhesive; and
f) a removable paper liner 74 which may be wax paper.

In use, the paper liner 74 is removed and a banknote removably attached to the liner, thereby forming a money clip similar to the separate label embodiment shown in FIGS. 1-11. Then the money clip is used in the same manner as the money clip of the separate label embodiment, that is, the money clip is folded such that the attached banknote overlies the money clip sticker 60*a* with the money clip sticker 60*a* being hidden.

Figure 13:
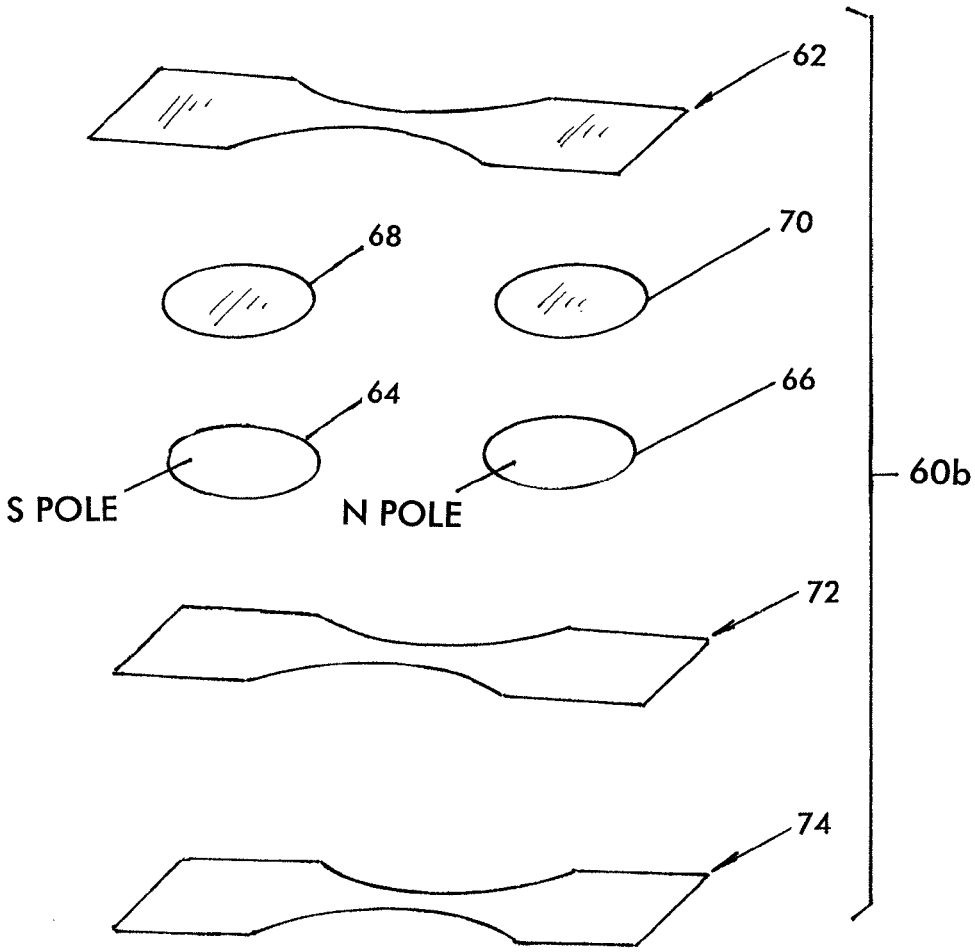
FIG. 13 is an exploded perspective view of a variant of the unitary magnetic sticker shown in FIG. 14 is a plan view of the unitary sticker of FIG. 13.

Alternatively, the money clip sticker may be folded in the opposite manner such that the money clip sticker is on top. In this case, it is advantageous to reverse the order of the magnetic discs 64 and 66 and steel sheets 68 and 70, as shown in FIG. 13 in the case of the magnetic sticker 60*b*. Reversing the order of the magnetic discs 64 and 66 and steel sheets 68 and 70 assures that the facing magnetic discs are unshielded when the sticker is on top.

Figure 14:
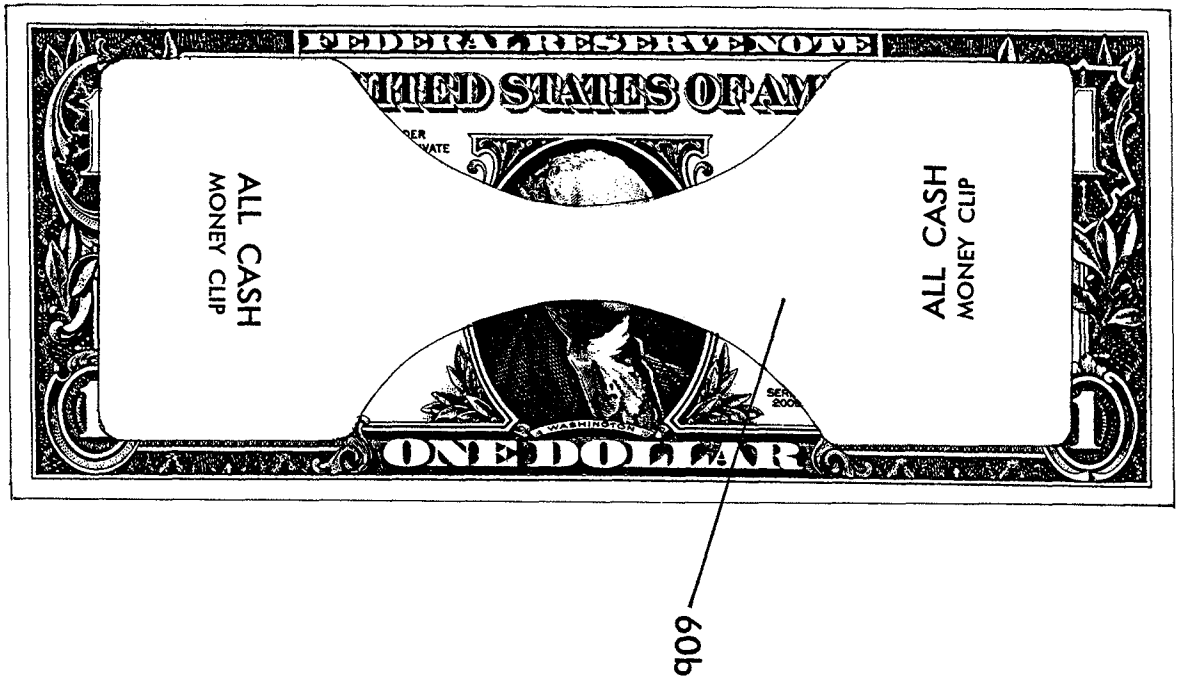

One of the advantages of having the sticker 60*b* on top allows corporate logos, advertising or other messages to be placed on the outer surface by printing, decals or any other suitable means, as shown in FIG. 14.

Figure 17:
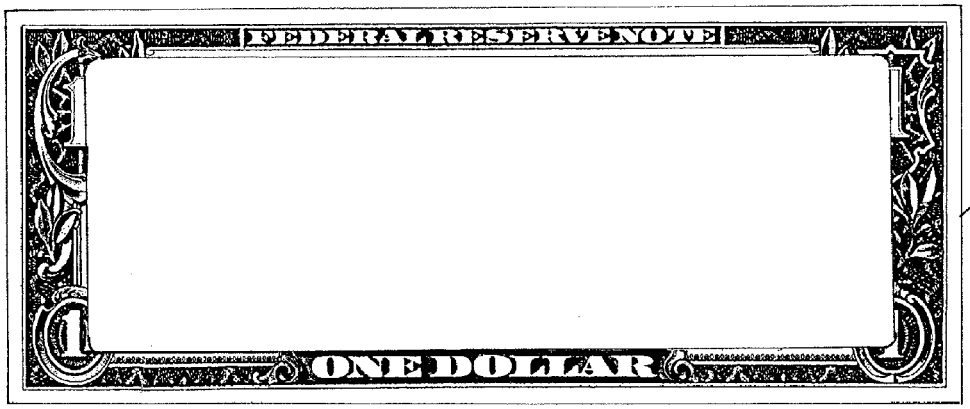
FIGS. 15-17 depict plan views of three exemplary shapes of unitary magnetic stickers constructed in accordance with the method of assembly illustrated in FIG. 13.
Figure 16:
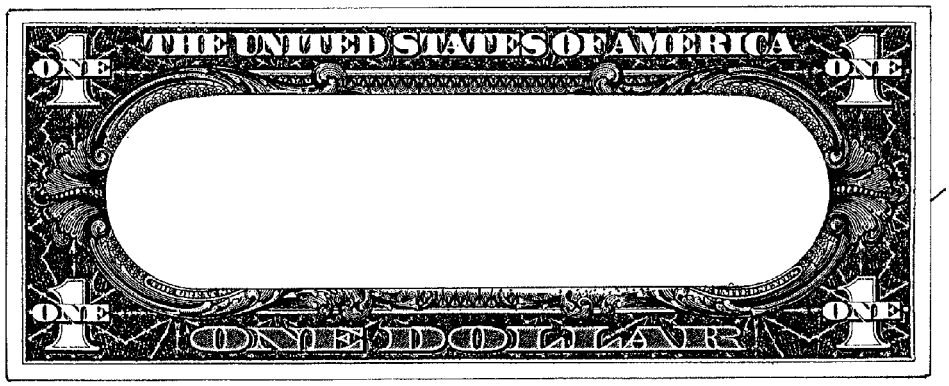
Figure 15:
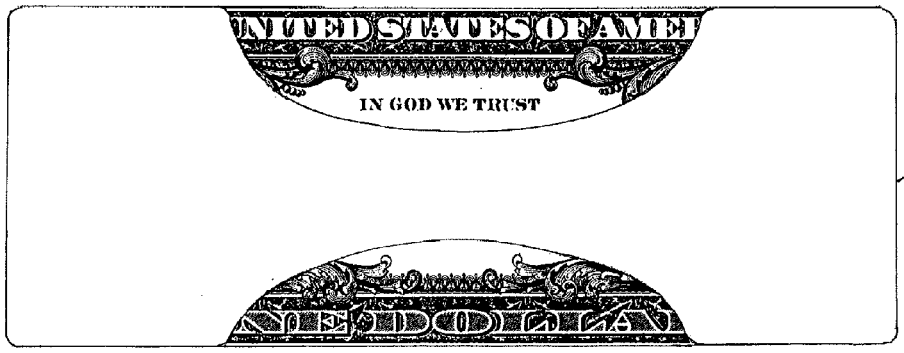

The sticker may have many different shapes. See, for examples, the stickers 60*b*, 60*c* and 60*d* of FIGS. 15-17. The sticker also may be of any color. Further, as should be apparent, the sticker may also be used as a money clip without first attaching it to a banknote.

While this invention has been illustrated and described in accordance with preferred embodiments of the present invention, it is recognized that variations and changes may be made therein. Thus, for example, while the illustrative embodiments shown and described herein have employed a real one-dollar bill as the paper substrate, a substrate made of ordinary paper is within the scope of the present invention. It is also possible to attach the magnetic components between two sheets of paper (two paper substrates) or two banknotes.

Also, while the magnetic clip has been described as preferably being used as a money clip, it should be understood that its use is not so limited and that it may be used as a clip for anything.

What is claimed is:

1. A magnetic clip sticker assembly comprising:

a flexible substrate having a first surface and a second surface opposite the first surface;

a pair of magnetic components;

a double-sided adhesive tape having a first surface and a second surface opposite the first surface, the magnetic components residing between the first surface of the double-sided adhesive tape and the second surface of the flexible substrate at spaced locations, each location being on a respective side of a central region of the flexible substrate;

a removable liner attached to the pressure sensitive adhesive layer, wherein the second surface of the double-sided adhesive tape has a pressure sensitive adhesive layer configured to attach the double-sided adhesive tape to a paper-based substrate, and configured so that when the double-sided adhesive tape is removed from the paper-based substrate the pressure sensitive adhesive on the second surface of the double-sided adhesive tape does not damage the paper-based substrate; and wherein at least the flexible substrate and the double-sided tape of the magnetic clip sticker have smaller areas than the paper-based substrate, whereby when attached to one side of the paper-based substrate the flexible substrate and the double-sided adhesive tape do not extend beyond peripheral edges of the paper-based substrate and cannot be seen directly from another opposite side of the paper-based substrate.

2. The magnetic clip sticker according to claim 1, wherein each magnetic component comprises one magnet and one plate of steel.

3. The magnetic clip sticker according to claim 2, wherein the magnet and steel plate of each of the magnetic components are arranged in tandem.

4. The magnetic clip sticker according to claim 2, wherein the magnet and steel plate of each of the magnetic components are arranged in tandem with the magnet being disposed adjacent the flexible substrate and the steel plate being behind the magnet.

5. The magnetic clip sticker according to claim 2, wherein the magnet and steel plate of each of the magnetic components are arranged in tandem with the steel plate disposed adjacent the flexible substrate and the magnet being behind the steel plate.

6. A magnetic clip that includes a magnetic clip sticker according to claim 1, wherein a real paper banknote is removably attached to the pressure sensitive adhesive layer.

7. A magnetic money clip, comprising:

a paper-based substrate;

a flexible substrate having a first surface and a second surface opposite the first surface;

a pair of magnetic components;

a double-sided adhesive tape having a first surface and a second surface opposite the first surface, the magnetic components residing between the first surface of the double-sided adhesive tape and the second surface of the flexible substrate at spaced locations, each location being on a respective side of a central region of the flexible substrate;

wherein the second surface of the double-sided adhesive tape has a pressure sensitive adhesive layer that is attached to the paper-based substrate, wherein the pressure sensitive adhesive layer is configured to be detached from the paper-based substrate without damaging the paper-based substrate when the double-sided adhesive tape is removed from the paper-based substrate, and wherein the flexible substrate and the double-sided adhesive tape have smaller areas than the paper-based substrate and are attached to one side of the paper-based substrate so that the flexible substrate and the double-sided adhesive tape do not extend beyond peripheral edges of the paper-based substrate and cannot be seen directly from another opposite side of the paper-based substrate.

* * * * *